United States Patent [19]

Franco

[11] Patent Number: 4,991,245

[45] Date of Patent: Feb. 12, 1991

[54] PORTABLE PILLOW/LOUNGE SET CONVERTIBLE TO AND FROM A TOTE BAG, AND METHOD

[75] Inventor: Jack Franco, Deal, N.J.

[73] Assignee: Franco Manufacturing Co. Inc., Metuchen, N.J.

[21] Appl. No.: 411,995

[22] Filed: Sep. 25, 1989

[51] Int. Cl.[5] ..... A47G 9/06

[52] U.S. Cl. ..... 5/419; 5/417; 5/485; 5/490; 5/502; 190/1; 383/4

[58] Field of Search ..... 5/417–420, 5/502, 485, 490; 190/1, 2; 383/4

[56] References Cited

U.S. PATENT DOCUMENTS

| | | | |
|---|---|---|---|
| 2,315,126 | 7/1939 | Parnow | 5/417 |
| 2,659,404 | 11/1953 | Kelsey | 383/4 |
| 2,783,473 | 3/1957 | Humpeler | 5/417 |
| 4,097,944 | 7/1978 | Yulish | 5/419 |
| 4,195,378 | 4/1980 | Porker | 5/419 |
| 4,231,125 | 11/1980 | Tittl | 5/419 |
| 4,413,368 | 11/1983 | Schuetze | 5/502 |
| 4,516,668 | 5/1985 | Grayek | 5/417 |
| 4,546,507 | 10/1985 | Weinstein | 5/417 |
| 4,600,091 | 7/1986 | McLeod | 5/417 |
| 4,671,393 | 6/1987 | Rainey | 5/417 |

FOREIGN PATENT DOCUMENTS

| | | | |
|---|---|---|---|
| 2047548 | 4/1971 | Fed. Rep. of Germany | 383/4 |
| 2568756 | 2/1986 | France | 190/1 |
| 77288 | 9/1949 | Norway | 5/419 |
| 1407484 | 9/1975 | United Kingdom | 190/2 |

*Primary Examiner*—Gary L. Smith
*Assistant Examiner*—F. Saether
*Attorney, Agent, or Firm*—Steinberg & Raskin

[57] ABSTRACT

A portable lounge/pillow, the lounge portion being made of a sheet material such as plastic or fabric, is convertible to and from a tote bag for carrying articles by folding portions of a sheet over and upon one another about transverse and longitudinal folds to form interior article-holding compartments. Carrying handles are positioned in registry with each other after folding of the sheet portions, and serve as a convenient hand-grip for carrying the articles. A cover sheet is detachably mounted on a sheet such as a fabric sheet for user comfort. A strap hanger enables the lounge/pillow set to be supportably suspended for air drying. Additional article-holding pockets are formed in the sheet for increased carrying capacity. A device for securing the lounge/pillow in a roll without having to deflate the pillow may be provided.

19 Claims, 3 Drawing Sheets

FIG.1
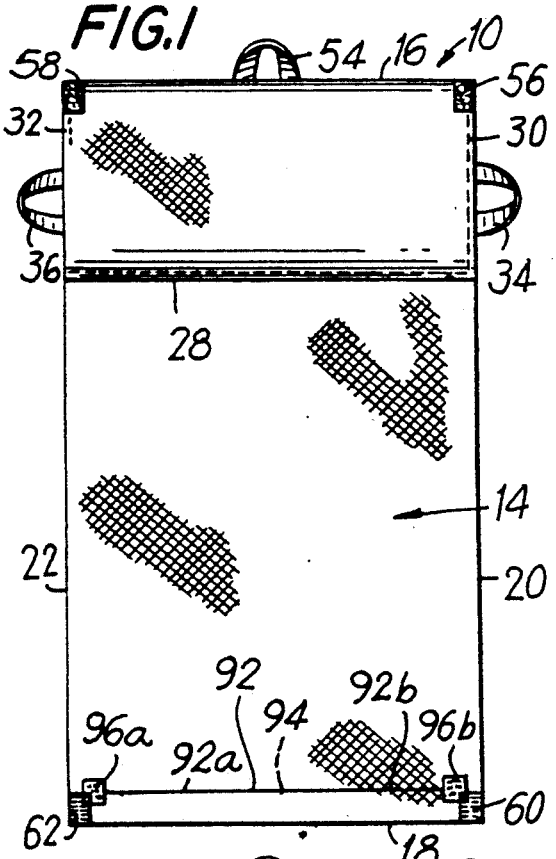
FIG.2
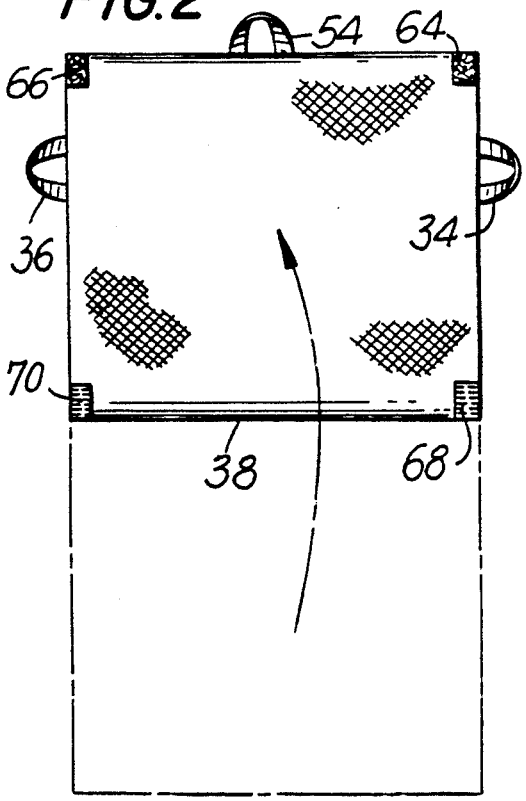
FIG.3
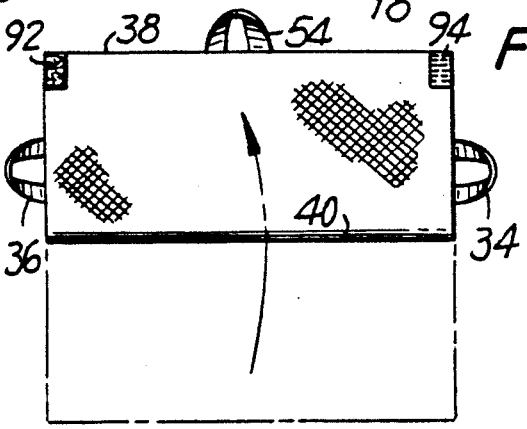
FIG.4
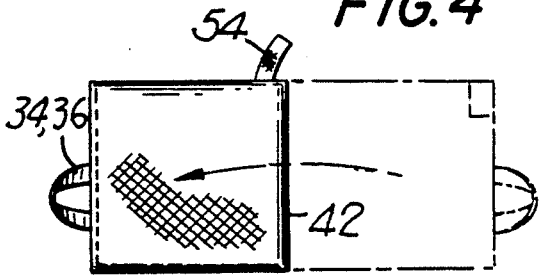
FIG.5
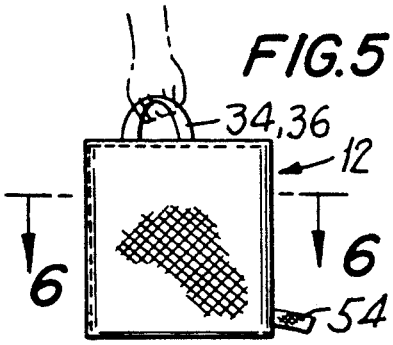
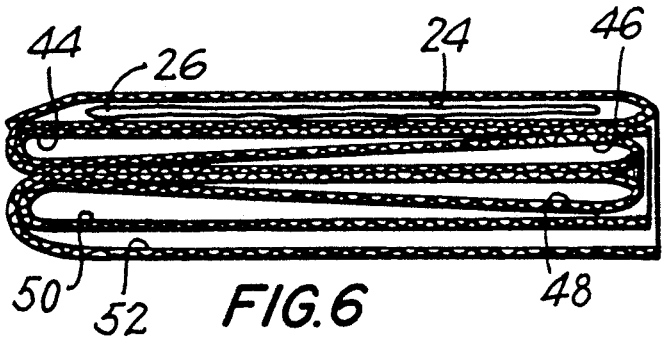
FIG.6

FIG. 7
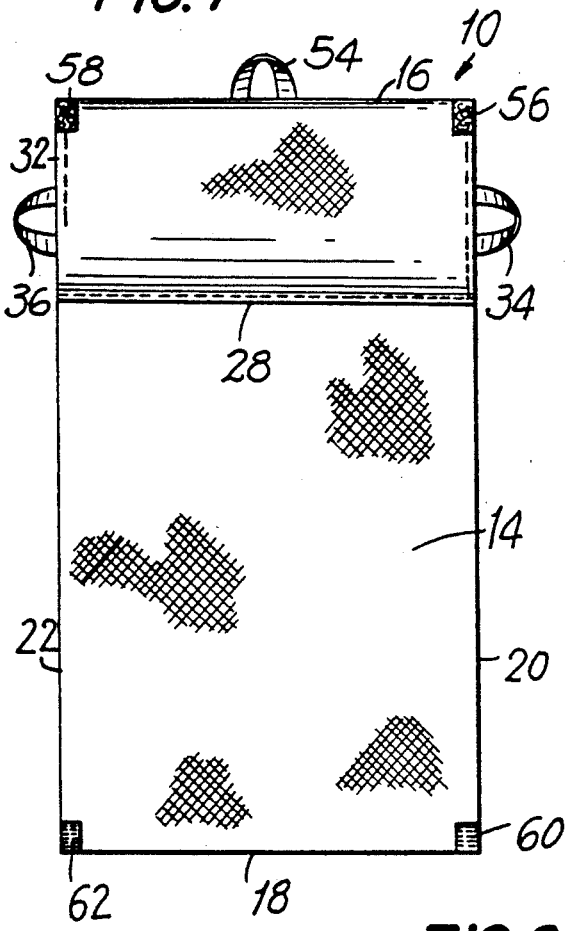
FIG. 8
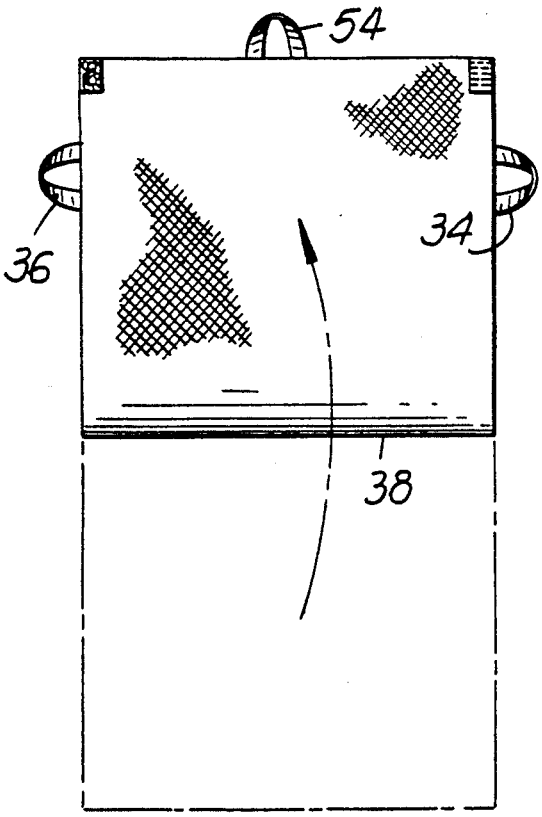
FIG. 9
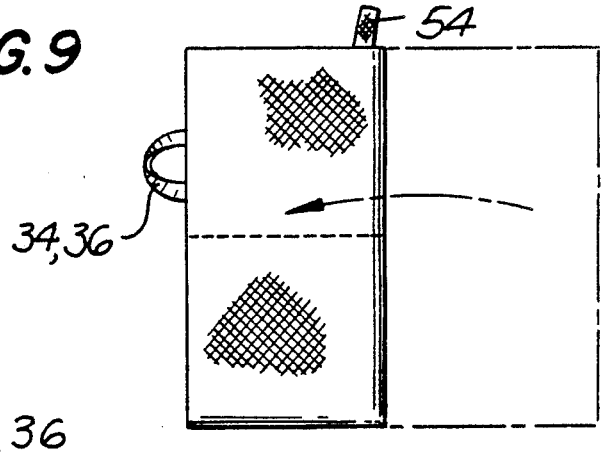
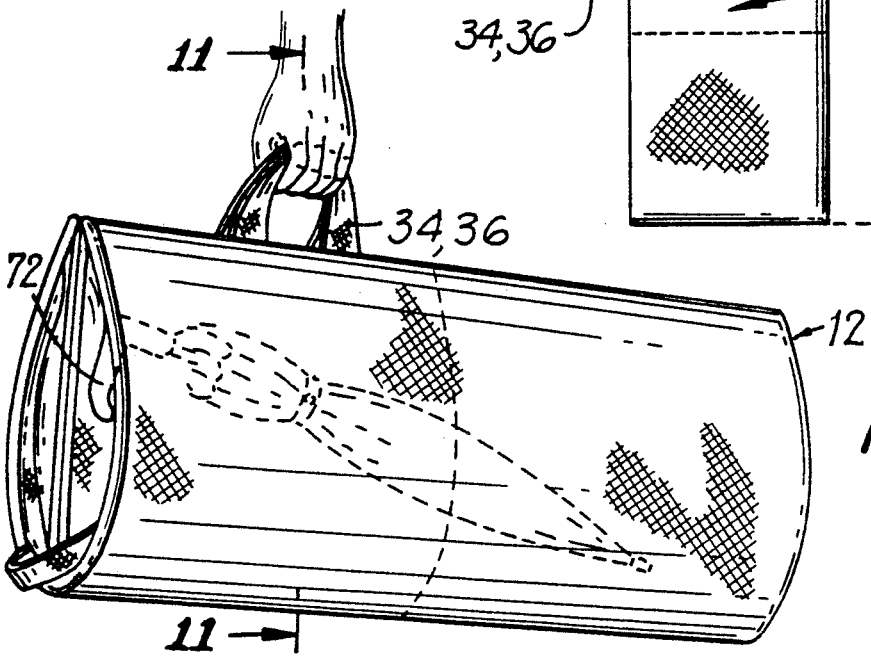
FIG. 10

PORTABLE PILLOW/LOUNGE SET CONVERTIBLE TO AND FROM A TOTE BAG, AND METHOD

BACKGROUND OF THE INVENTION

1. Field of the Invention

This invention generally relates to a lounge, made of a sheet material such as plastic or a fabric which can be a quilt, blanket, towel, etc., in combination with a pillow for comfortably supporting a person and, more particularly, a method for converting such a combination to and from a tote bag for conveniently hand-carrying articles.

2. Description of Related Art

Persons visiting a beach, a swimming pool and like recreational settings, for sunbathing, swimming and like recreational pursuits frequently do so armed with a host of refreshments and paraphernalia. Food and drink, often in coolers, are brought in quantity in order to last for quite a while since such outings typically last several hours or all day. Sun preparations either to promote or hinder tanning, sun shields, eye goggles, bathing suits and caps, towels, brushes, combs, changes of clothing, etc., are just some examples of the personal paraphernalia that is carried to such outings. Also contributing to the overall load are beach chairs, lounges, sun umbrellas, blankets, etc. In the case where families attend such an outing, it is not uncommon for several family members to spend a considerable amount of time packing all this paraphernalia in multiple shopping bags and carrying such heavily laden bags in multiple trips to and from the recreational site, thereby diminishing somewhat from the overall recreational aspects of the outing.

It has been proposed in U.S. Pat. No. 3,689,947 to combine a water-absorbent towel and an inflatable pillow so that a person may recline on the towel and place his or her head comfortably on the pillow. When deflated, the pillow is compactly stored in a internal pocket formed in the towel. Among other advantages, such towel/pillow sets are more compact and lighter than beach chairs, lounges and like recliners, and do ease the burden and bother described above in connection with undertaking such an outing. However, the refreshments and other paraphernalia still must be carried in separate and multiple bags representing a major annoyance and inconvenience.

Also, the known towel/pillow sets, when dampened by a bather, tend to stay wet for a long time. Furthermore, the known towel/pillow sets only underlie an individual. In some cases, for greater comfort, it would be desirable to cover the individual.

Still further, there are occasions at home when it is desired to lounge on the floor. For example, in the case of children, or even adults, lying on a quilt or blanket (such as a flannel blanket) or the like. In these cases too it may be desirable to carry items to the playroom, for example, and also to cover the individual.

SUMMARY OF THE INVENTION

1. Objects of the Invention

It is a general object of this invention to convert a lounge/pillow set, for example a towel/pillow set, into a tote bag for convenient carrying of recreational paraphernalia.

It is another object of this invention to provide such a convertible set which lends itself to convenient, compact storage.

A further object of this invention is to ease the inconvenience and annoyance of carrying multiple bags loaded with paraphernalia to and from a recreational site.

A still further object of the invention is to provide a lounge/pillow set, for example a towel pillow, with means for securing the same in a roll without having to deflate the pillow.

Still another object of this invention is to expedite the drying of towel/pillow sets.

Yet another object of this invention is to cover an individual with an overlying sheet for greater user comfort.

2. Features of the Invention

In keeping with these objects, and others which will become apparent hereinafter, one feature of this invention resides, briefly stated, in a lounge/pillow set convertible to and from a tote bag. The lounge set comprises an elongated sheet portion, of for example, plastic or fabric, such as a quilt, a blanket or a towel having end regions, side regions, a length extending along a longitudinal direction between the end regions, and a width extending along a transverse direction between the side regions of the lounge. The length of the lounge, e.g. towel, is several times greater than the width thereof.

For simplicity of discussion, the description which follows will be mainly directed to a towel/pillow set. It is to be understood, however, that the invention is in all respects applicable to any sheet lounge/pillow set such as a quilt/pillow set, a blanket/pillow set, a plastic or cotton, sheet/pillow set, etc.

The towel has a pillow pocket extending along the transverse direction along the width of the towel at one of the end regions thereof. A pillow is removably mounted in the pillow pocket. Preferably, the towel is folded back upon itself at said one end region, and terminates in a transverse edge stitched to the remainder of the towel to form the pocket. The towel has superimposed side edges stitched together completely along one side of the pocket, but only partly along an opposite side of the pocket to form the entrance through which the pillow may be introduced into and removed from the pocket. To facilitate such introduction and removal, the pillow is preferably inflatable with air.

The set further comprises a pair of handles, one attached at each side region of the towel, and also has foldable towel portions. In the method of the invention, the towel portions are folded over and upon one another about transverse and longitudinal folds respectively parallel to the transverse and longitudinal directions to form at least one interior compartment for holding articles. After folding of the towel portions about the longitudinal fold, the handles are positioned in registry with each other to form a convenient hand-grip for carrying the articles.

According to one preferred embodiment, the towel is folded twice about two different transverse folds before being folded once about a single longitudinal fold in order to form a substantially flat, compact tote bag having a pair of the article-holding compartments. According to another embodiment, the towel is only folded once about a single transverse fold before being folded once about a single longitudinal fold to form the tote bag.

Thus, a towel/pillow set is conveniently and rapidly converted into a tote bag which can be used for the convenient hand-carrying of recreational paraphernalia. The aforementioned interior compartment, together with additional compartments that are formed during the folding of the towel portions, can be used to reduce the number of shopping bags used to carry the host of paraphernalia to the recreational site. The inconvenience and annoyance of carrying multiple bags laden with articles is therefore lessened.

Another feature of this invention is embodied in attaching a strap hanger at one of the end regions of the towel. The towel may be conveniently supportably suspended from the strap hanger. This expedites the drying of the towel.

Still another feature of this invention resides in mounting a cover sheet on the towel for folding movement about either one of the end regions or one of the side regions thereof. Preferably, the cover sheet is detachably mounted on the towel. This enables the individual to cover himself or herself for greater comfort, e.g. to either block out the sun's rays or to protect oneself from the cold.

VELCRO-type fasteners are provided on superimposed towel portions or the cover sheet in order to releasably fasten the superimposed towel portions or cover sheet. Additional article-holding pockets may be formed in the towel, preferably at a foot end region thereof, to increase the carrying capacity of the tote bag.

According to another feature of the invention, flexible tie members may be provided at the lower end region of the towel for securing the towel/pillow in a roll without having to deflate the pillow.

As can be readily inferred from the heretofore stated description of the invention, the method of the invention is directed to converting a portable sheet lounge/-pillow set to a tote bag and comprises the steps of:

(a) providing an elongated sheet with end regions, side regions, a length extending along a longitudinal direction between the end regions of the sheet, and a width extending along a transverse direction between the side regions of the sheet, the length being greater than the width of the sheet;

(b) forming a pillow pocket in which a pillow is removably mounted at one of the end regions of the sheet along the width of the sheet;

(c) attaching a pair of handles, one at each side region of the sheet;

(d) folding portions of the sheet over and upon one another first about one or two transversal folds, then about a single longitudinal fold to form a plurality of interior compartments for holding articles; and (e) positioning the handles in registry with each other after folding the sheet portions about the longitudinal fold to form a convenient hand-grip.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a top plan view of a lounge/pillow set, in the embodiment shown a towel/pillow set, convertible to and from a tote bag according to one embodiment of this invention, and also including means for securing the set in a roll without having to deflate the pillow;

FIG. 2 is a view analogous to FIG. 1, but showing the towel after having been folded once about a transverse fold;

FIG. 3 is a view analogous to FIG. 1, but showing the towel after having been folded twice about two transverse folds;

FIG. 4 is a view of the towel of FIG. 3 after having been folded once about a longitudinal fold;

FIG. 5 is a front view of the tote bag formed from the embodiment of FIG. 1;

FIG. 6 is an enlarged sectional view taken on line 6--6 of FIG. 5;

FIG. 7 is a top plan view of a towel/pillow set convertible to and from a tote bag according to another embodiment of this invention;

FIG. 8 is a view analogous to FIG. 7, but showing the towel after having been folded once about a transverse fold;

FIG. 9 is a view of the folded towel of FIG. 8 after being folded once about a longitudinal fold;

FIG. 10 is a perspective view of a tote bag formed from the embodiment: of FIG. 7;

DETAILED DESCRIPTION OF THE PREFERRED EMBODIMENTS

Figure 11:
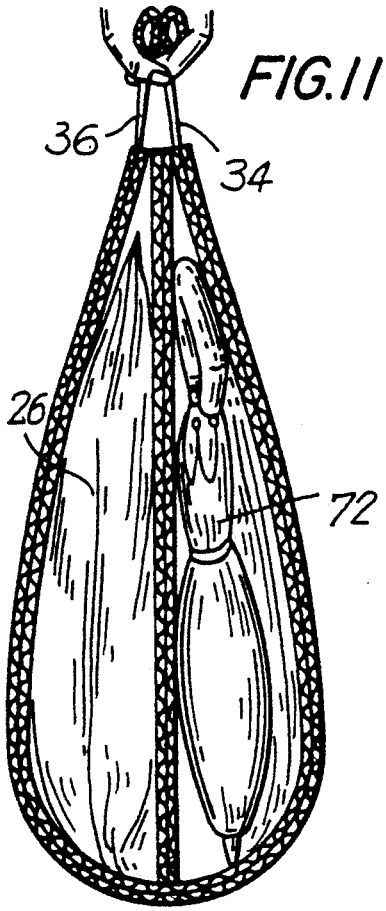
FIG. 11 is an enlarged sectional view taken on line 11--11 of FIG. 10.

Referring now to FIGS. 1–6 of the drawings, reference numeral 10 identifies a first embodiment of a lounge/pillow set which is convertible to and from a tote bag, shown schematically in FIG. 5 and identified by reference numeral 12. The set 10 includes an elongated sheet such as a fabric sheet, e.g., a towel 14 having an upper end region 16, a lower end region 18, and a pair of side regions 20, 22. The towel 14 has a length extending along a longitudinal direction between the end region 16, 18, as well as a width extending along a transverse direction between the side region 20, 22. The length is several times greater than the width of the towel. The sheet has a generally rectangular shape as seen in plan view, and, in the case of a towel, may be constituted of any suitable water-absorbent toweling material, such as terrycloth.

The towel 14 has a pillow pocket 24 (see FIG. 6) which extends along the transverse direction along the entire width of the towel at one of the end regions thereof. An inflatable pillow 26, shown deflated in FIG. 6, is removably mounted in the pillow pocket 24. The towel is folded back upon itself at its upper end region, and terminates in a transverse edge 28 stitched to the remainder of the towel in order to form the pocket 24. The towel has superimposed side edges 30 stitched together completely along one side of the pocket at side region 20 in order to completely close that side of the pocket. The towel also has superimposed side edges 32 stitched together partly along an opposite side of the pocket at side region 22 to form an entrance through which the pillow 26 may be introduced into, and removed from, the pocket. The flexibility of the pillow, particularly when it is of the inflatable type, enables it to be easily introduced into and removed from the pocket.

According to this invention, a pair of handles 34, 36 are attached respectively at each side edge region 20, 22 of the towel. The towel has towel portions foldable over and upon one another about transverse and longitudinal folds respectively parallel to the transverse and longitudinal directions in order to form at least one interior compartment for holding articles. Specifically, as shown in FIG. 2, the lower portion of the towel is folded initially about a first transverse fold 38 and, thereupon, as shown in FIG. 3, about a second, different transverse fold 40 prior to being folded once more about a single longitudinal fold 42 in order to form the tote bag 12 of FIG. 5. As shown in FIG. 6, the tote bag 12 has multiple interior compartments 44, 46, 48, 50, 52, each of which can be used for holding recreational paraphernalia of the type particularly suited for beach use, swimming pool use and other recreational pursuits.

When the towel portions are folded about longitudinal fold 42, the handles 34, 36 are brought into registry with each other, thereby together forming a convenient hand-grip for the tote bag.

Another handle or strap hanger 54 is attached at the upper end edge region 16 in a central location in order to enable the set 10 to be supportably suspended on a convenient support to expedite drying of the towel when dampened by a bather.

In accordance with one embodiment, VELCRO-type fasteners of the hook-and-loop type are respectively positioned on those areas of the towel portions which are folded over and upon one another. Thus, first VELCRO-type fasteners 56, 58 are provided at opposite ends of the upper region 16, and complementary second VELCRO-type fasteners 60, 62 are provided at the opposite end of lower end region 18. Fasteners 56, 60 and 58, 62 respectively engage each other when the towel portions have been folded about transverse fold 38.

Additional VELCRO-type fasteners 64, 66 and 68, 70 are provided on the underside of the towel in order to releasably fasten those towel portions which are folded about transverse fold 40. Additional complementary VELCRO fasteners 92 and 94 may be provided on the underside of the towel adjacent to fasteners 70, 68 on the other side of fold 38 to fasten the towel portions that are folded about fold 42. In this case, only a single handle, e.g. handle 34, is required.

The strap hanger 54, which is shown in FIG. 5 outwardly of the bag, may be conveniently tucked inside one of the interior compartments for esthetic purposes.

Figure 1A:
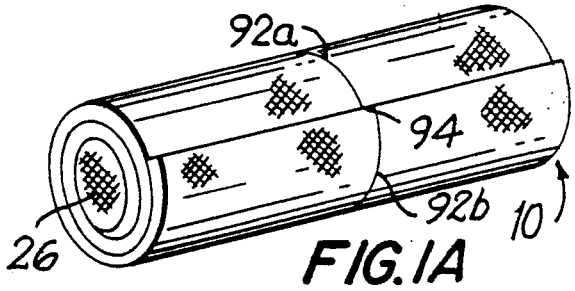
FIG. 1A is a perspective view of the towel/pillow set secured in a roll with the pillow in its inflated condition.

The towel/pillow set 10 is also provided with means by which the set may be rolled up and then secured in a roll with the pillow 26 in pocket 24 in its inflated condition. Referring to FIG. 1, a length of elastic cord 92 is sewn at 94 to the reverse side of towel 14 at its lower end region to form a pair of flexible tie members **92*a* and 92*b*. VELCRO-type fasteners 96*a* and 96*b* are connected to the free ends of tie members 92*a* and 92*b*. When the towel/pillow set 10 is in use, either as a lounge or as a tote, the fasteners 96*a* and 96*b* are fastened to VELCRO-type fasteners 62 and 60 respectively so that the tie members do not come loose. Referring to FIG. 1A, if desired, the towel/pillow set may be rolled up starting from the upper end region 16, with pillow 26 situated within pocket 24 in its inflated condition, into a roll whereupon the ends of the members 92*a* and 92*b* are disconnected from fasteners 62 and 60**, looped around the roll and tied to each other (not shown) to secure the towel/pillow in a roll.

Turning now to the embodiment of FIGS. 7–11, the structure and function of this embodiment is exactly identical to that of the embodiment of FIGS. 1–6, except that the second folding step about transverse fold 40 has been eliminated, thereby resulting in a tote bag which, as shown in FIG. 10, resembles a dufflebag rather than the tote bag of FIG. 5 which resembles a shopping bag. Otherwise, the same reference numerals used in the first embodiment have been incorporated in the second embodiment, and a detailed description of the second embodiment is not believed to be necessary. It should be noted, however, that the interior compartments of the bag illustrated in FIGS. 10 and 11 are longer so that relatively long objects can be accommodated therein. Thus, an umbrella 72 is shown as being entirely accommodated in one of the interior compartments.

Figure 12:
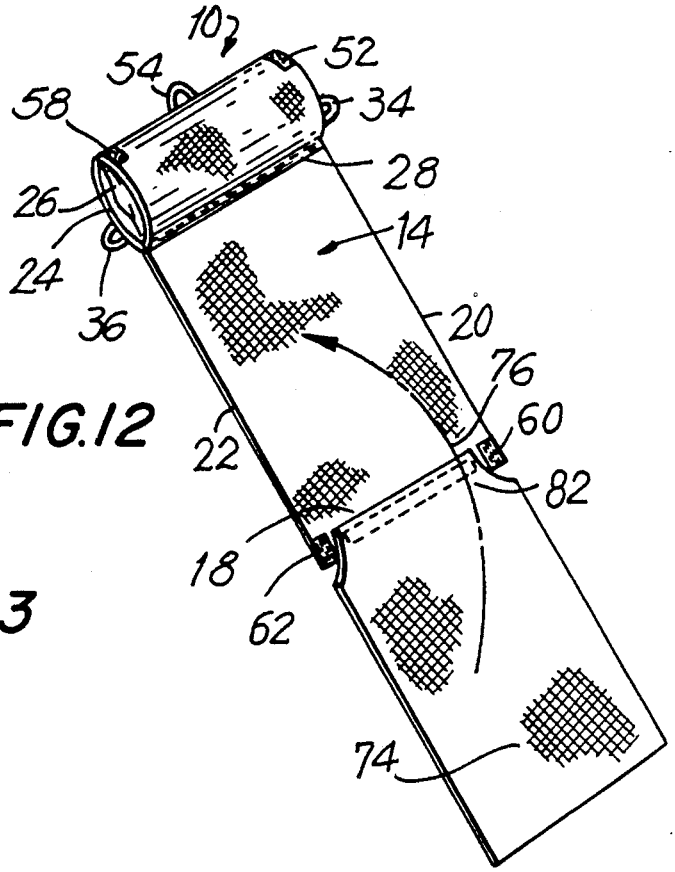
FIG. 12 is a front perspective view of another embodiment of this invention equipped with a cover.
Figure 13:
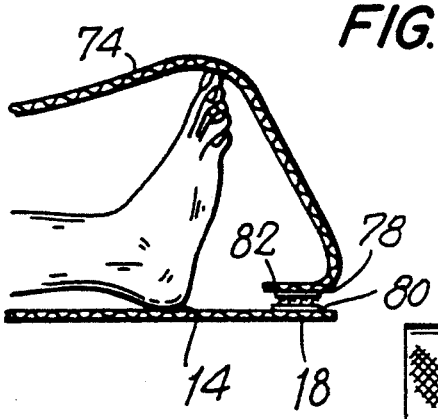
FIG. 13 is a partly broken away, partly sectional view of the cover of FIG. 12 shown in use.

Turning now to FIGS. 12 and 13 where, again, like reference numerals have been utilized to identify like parts, the towel/pillow set 10 still further includes a cover sheet 74 mounted on the towel for folding movement in the direction of the curved arrow 76 in order to cover a user (see FIG. 13). A strip 78 of first VELCRO-type material and a juxtaposed second strip 80 of complementary VELCRO-type material are provided respectively along a lower end region 82 of the cover sheet 74 and the lower end region 18 of the towel 14. By peeling the VELCRO strips from each other, the cover sheet is separately detachably mounted on the towel and can be removed from the towel for separate washing purposes.

Figure 14:
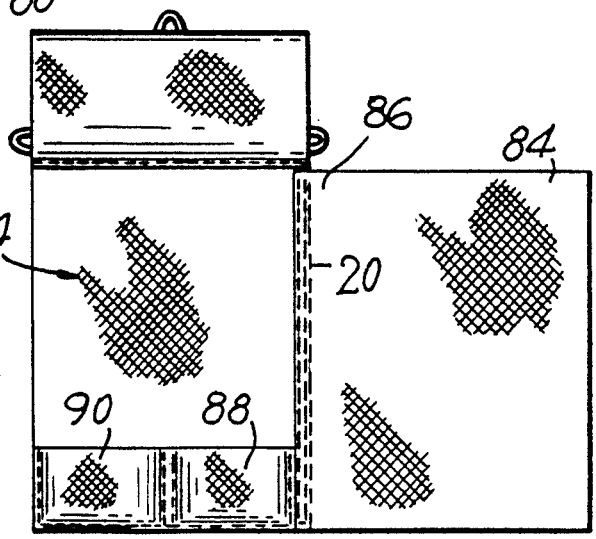
FIG. 14 is a top plan view of still another embodiment of a towel/pillow set according to this invention equipped with a cover and two side-by-side auxiliary pockets for holding paraphernalia.

Rather than mounting the cover sheet 74 for folding movement along juxtaposed end regions of the cover and the towel at the foot of the towel, the cover sheet 74 may be mounted at one of the side regions, e.g. side region 20. Thus, as shown in FIG. 14, cover sheet 84 has a side edge region 86 along which a strip of VELCRO is attached. This strip overlies a corresponding strip of complementary VELCRO along side region 20 of towel 14 in order to enable the cover sheet 84 to be folded over a user from the side. A pair of side-by-side, article-holding pockets 88, 90 are formed at the lower end region of the towel to provide an additional means for carrying articles in the tote bag. Pockets 88, 90 are upwardly open in a direction which faces toward the pillow pocket.

It will be understood that each of the elements described above, or two or more together, also may find a useful application in other types of constructions differing from the types described above.

While the invention has been illustrated and described as embodied in a towel/pillow set convertible to and from a tote bag, and method, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A portable lounge/pillow set convertible to and from a tote bag, comprising:

(a) an elongated sheet having end regions, side regions, a length extending along a longitudinal direction between the end regions of the sheet, and a width extending along a transverse direction between the side regions of the sheet, said length being greater than the width of the sheet, said sheet having a pillow pocket extending along the transverse direction along the width of the fabric sheet at one of the end regions thereof;

(b) a pillow removably mounted in the pillow pocket;

(c) a pair of handles, one attached at each side region of the sheet;

(d) said sheet having sheet portions integral and permanently attached with one another and foldable over and upon one another about transverse and longitudinal folds respectively parallel to the transverse and longitudinal directions to form at least one interior compartment for holding articles; and (e) said handles being positioned in registry with each other after folding of the sheet portions about the longitudinal fold to form a convenient hand-grip for carrying the articles and wherein the sheet is folded only once about a single transverse fold before being folded only once about a single longitudinal fold to form a substantially flat tote bag having a plurality of said article-holding compartments.

2. The invention according to claim 1, wherein said sheet is a fabric sheet.

3. The invention according to claim 1, wherein the fabric sheet is folded back upon itself at said one end region and terminates in a transverse edge stitched to the remainder of the fabric sheet to form the pocket; said fabric sheet having superimposed side edges stitched together completely along one side of the pocket, but only partly along an opposite side of the pocket to form an entrance through which the pillow may be introduced into and removed from the pocket.

4. The invention according to claim 1, and further comprising means for releasably fastening the sheet portions together after folding.

5. The invention according to claim 4, wherein the fastening means includes a first fastener on one of the sheet portions, and a second mating fastener on another of the sheet portions which is superimposed on said one sheet portion after folding.

6. The invention according to claim 1, and further comprising a strap hanger attached at said one end region from which the set is supportably suspended.

7. The invention according to claim 2; and further comprising a cover sheet mounted on the fabric sheet for folding movement.

8. The invention according to claim 7, wherein the cover sheet is detachably mounted on the fabric sheet along the other end region thereof.

9. The invention according to claim 7, wherein the cover sheet is detachably mounted on the fabric sheet along one side region thereof.

10. The invention according to claim 7, wherein a first fastener is mounted on the cover sheet, and a second mating fastener is mounted on the fabric sheet.

11. The invention according to claim 1, wherein at least one article-holding pocket is located at the other end region of the sheet.

12. The invention according to claim 11, wherein another article-holding pocket is located in side-by-side relation at the other end region of the sheet.

13. The invention according to claim 2, wherein said fabric sheet is a guilt, blanket or towel.

14. The invention according to claim 1, wherein said pillow is inflatable.

15. A method of converting a portable sheet lounge/-pillow set to a tote bag, comprising the steps of:

(a) providing an elongated sheet with sheet portions integral and permanently attached with each other and with end regions, side regions, a length extending along a longitudinal direction between the end regions of the sheet, and a width extending along a transverse direction between the side regions of the sheet, said length being greater than the width of the sheet;

(b) forming a pillow pocket in which a pillow is removably mounted at one of the end regions of the sheet along the width of the sheet;

(c) attaching a pair of handles, one at each side region of the sheet;

(d) folding portions of the sheet over and upon one another about only one transverse fold located at substantially the midpoint of said length and only one longitudinal fold respectively parallel to the transverse and longitudinal directions to form at least one interior compartment for holding articles; and (e) positioning the handles in registry with each other after folding the sheet portions about the longitudinal fold to form a convenient hand-grip.

16. The method according to claim 15, wherein the sheet is a fabric sheet.

17. THe method according to claim 15, wherein the folding step is performed by folding the sheet portions twice about two different transverse folds, and thereupon by folding the sheet portions once about a single longitudinal fold to form a substantially flat, compact tote bag having a pair of said compartments.

18. The method according to claim 15, wherein the folding step is performed by folding the sheet portions once about a single transverse fold, and thereupon by folding the sheet portions once about a single longitudinal fold to form a substantially flat, compact tote bag having a pair of said compartments.

19. The method according to claim 16, wherein the fabric sheet is a quilt, blanket or towel.

* * * * *